US005149179A

United States Patent [19]

Nash

[11] Patent Number: 5,149,179

[45] Date of Patent: Sep. 22, 1992

[54] AUTOMATIC CONTAINER COVER

[76] Inventor: Terrance E. Nash, RR 1, Salo Road, Sorrento, British Columbia, Canada, V0E 2W0

[21] Appl. No.: 690,768

[22] Filed: Apr. 24, 1991

[51] Int. Cl.[5] ..... A47B 81/00

[52] U.S. Cl. ..... 312/275; 312/321.5

[58] Field of Search ..... 312/321.5, 325, 326, 312/329, 270, 271, 275, 310, 211, 212; 49/70; 248/95, 97, 99; 220/908

[56] References Cited

U.S. PATENT DOCUMENTS

| | | | |
|---|---|---|---|
| 991,270 | 5/1911 | Bunn | 220/908 X |
| 1,767,874 | 6/1930 | Gillard . | |
| 2,247,232 | 6/1941 | Goldberg . | |
| 2,343,409 | 3/1944 | Goldberg . | |
| 2,558,939 | 7/1951 | Dornbush . | |
| 2,597,722 | 5/1952 | Goldberg . | |
| 3,014,684 | 12/1961 | Gould, Jr. | 312/275 X |
| 3,316,047 | 4/1967 | Murphy | 312/275 |
| 3,602,568 | 8/1971 | Bernhardsson . | |
| 3,922,046 | 11/1975 | Schneider | 312/291 X |
| 4,120,548 | 10/1978 | Manor | 312/325 X |
| 4,526,288 | 7/1985 | Schuld . | |
| 4,639,050 | 1/1987 | Neuhaus . | |
| 5,011,036 | 4/1991 | Souza et al. | 220/908 X |

FOREIGN PATENT DOCUMENTS 1199658 12/1959 France .

*Primary Examiner*—Joseph Falk
*Assistant Examiner*—Brian K. Green
*Attorney, Agent, or Firm*—Trask, Britt & Rossa

[57] ABSTRACT

A container (10) having a cover (42) mounted on a container body (32) that in turn is mounted to the interior surface (30) of a cabinet door (28) that uses an elastic, flexible filament (56) to automatically open and close the container cover (42) as the cabinet door (28) is opened and closed. The elastic, flexible filament (56) may be mounted to not only urge the cover (42) to move to an open position as the cabinet door (28) is opened, but also urge the cover (42) to move to a closed position when the door (28) is closed and hold the cover (42) in the closed position. With the device of the present invention, existing door-mounted containers can be quickly and easily installed or converted to use the present invention without requiring alteration of the cabinet structure. Furthermore, with the present invention, manual opening and closing of the container cover (42) is eliminated and the container cover (42) is held in the closed position.

9 Claims, 3 Drawing Sheets

FIG. 5
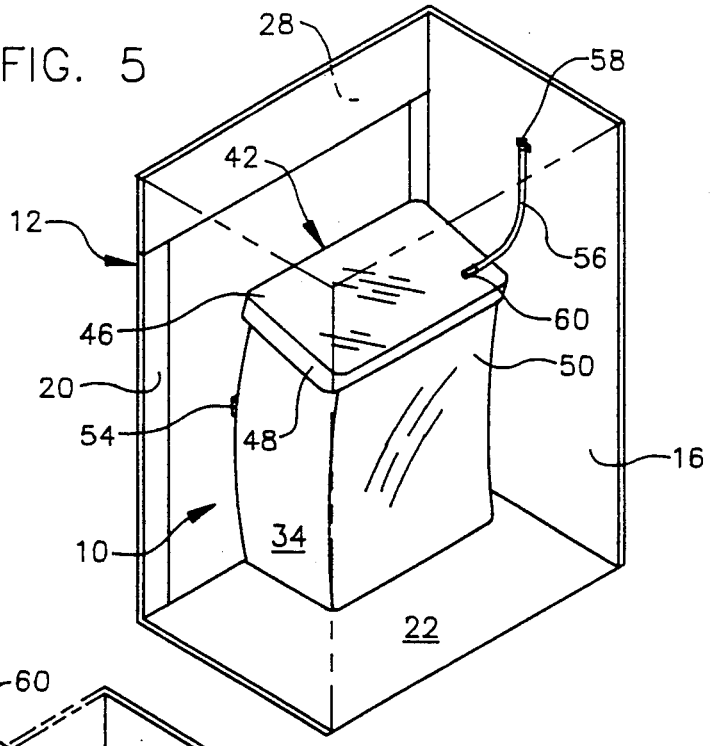
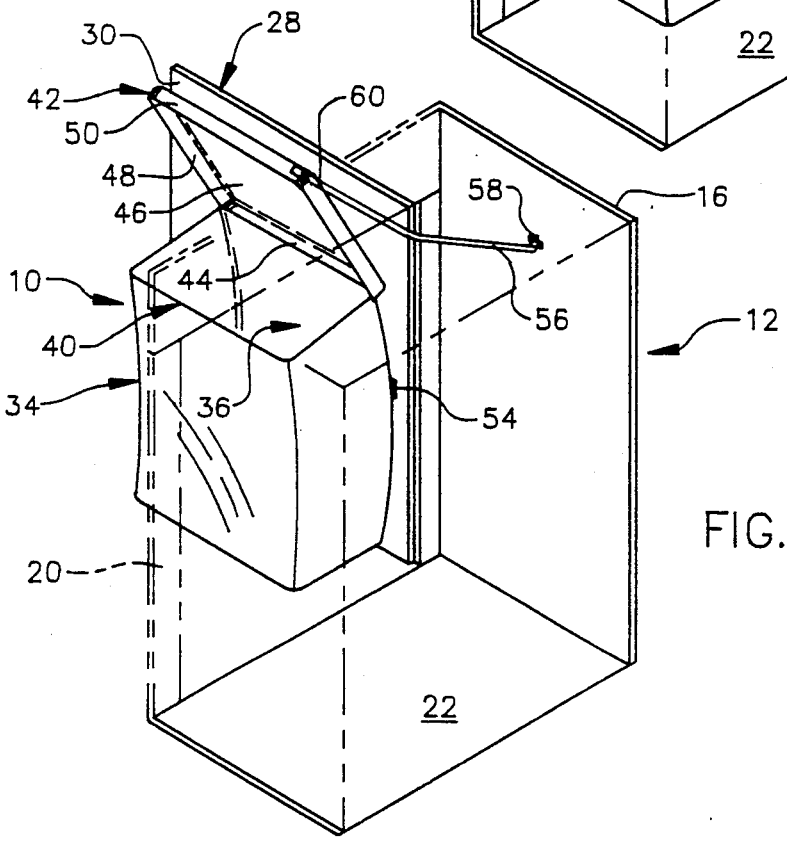
FIG. 6

AUTOMATIC CONTAINER COVER

TECHNICAL FIELD OF THE INVENTION

The present invention pertains to containers having automatically opening covers, and, more particularly, to a container mounted on a cabinet door and having an attached cover that automatically opens when the cabinet door is opens and automatically closes when the cabinet door closes.

BACKGROUND OF THE INVENTION

Refuse containers in residences and businesses are commonly stored inside a cabinet. This removes an unsightly container from view and prevents the dispersion of unpleasant odors. A disadvantage to this type of storage is the difficulty of access to the container. More particularly, the cabinet door must be opened and a user must reach in under the cabinet to physically open the container lid and place the refuse inside the container, after which the container lid must be closed. This is awkward and requires physical effort when the cabinet is at a low level.

One method for overcoming these disadvantages is to mount the container on the inside of the cabinet door. When the cabinet door is closed, the container is stored inside of the cabinet. When the cabinet door is opened, the container is swung out to allow easy access. However, even this method has the drawback of requiring a user to bend over, open the container lid, place the refuse within the container, and then close the container lid, after which the cabinet door must be closed. Doing this a number of times per day can be tiring and cause stress and strain on the back, arms, and shoulders.

To overcome this drawback, a number of methods have been developed to automatically open the lid of the container when the cabinet door is opened and automatically close the lid of the container when the cabinet door is closed. For instance, U.S. Pat. No. 2,247,232 discloses a container mounted on a support platform for movement into and out of a cabinet. A flexible member has one end attached to the back of the cabinet and the other end attached to the lid of the container. As the cabinet doors are opened, the container is pulled out of the cabinet and the flexible member pulls the lid back, thus opening the lid as the container exits the cabinet. Closing of the doors moves the container back into the cabinet where the lid contacts the cabinet frame and is forced down. The obvious drawback to this device is the damage to the cabinet and the lid by requiring the lid to contact the cabinet frame to actuate closing. In addition, the flexible member must stretch completely across the open space of the cabinet, causing interference with plumbing and items stored in the cabinet. Finally, this particular container requires substantial modification to the cabinet and is complex and cumbersome. These apparent drawbacks were recognized by the inventor who obtained later patents, U.S. Pat. No. 2,343,409 and U.S. Pat. No. 2,597,722, which disclose a modified container having a mechanical scissorarm attached to the sliding platform and container that automatically opens and closes the lid without requiring contact with the cabinet structure and eliminating the flexible member. The containers disclosed in these later patents require significant alteration to the cabinet to install and use because the method of automatically opening the lid is mechanically complex and cumbersome. In addition, this method would not work with a container mounted on the swinging cabinet door.

Consequently, there is a need for a simple, yet effective method for opening and closing a container lid mounted on a container that in turn is mounted on a cabinet door without requiring modification to the cabinet structure and without using complex and cumbersome mechanical devices.

SUMMARY OF THE INVENTION

The present invention is directed to a container with an automatic cover for use in combination with a cabinet having an open wall and a door hingedly mounted over the open wall to pivot between an open position and a closed position. The container comprises a container body having sidewalls, a bottom, and an open top. The container body is mounted on the cabinet door. In addition, the container body includes a cover hingedly attached thereto to move between an opened position, wherein the open top is uncovered, and a closed position, wherein the open top is covered. An elastic, flexible filament having a first end and a second end is attached to the cabinet and container by attachment hardware for attaching the first end to the cabinet and means for attaching the second end to the container cover. When the cabinet door is closed, the elastic, flexible filament pulls the cover towards the closed position, and when the door is moved into the open position, the elastic, flexible filament stretches to urge the cover into the opened position.

In accordance with another aspect of the present invention, the cover includes a hinge that attaches the cover to the open top of the container body and the cover is positioned in substantially a horizontal orientation such that the hinge is vertically level with an opposing side of the cover. In this embodiment, the first end of the elastic, flexible filament is mounted to be vertically level with the second end of the elastic, flexible filament such that when the cabinet door is closed, the elastic, flexible filament pulls the cover towards the closed position. When the the cabinet door is moved to the open position, the elastic, flexible filament stretches to urge the cover into the opened position. Alternatively, the first end of the elastic, flexible filament can be positioned on the cabinet to be vertically lower than the second end of the elastic, flexible filament to pull and hold the cover in the closed position.

In accordance with another aspect of the present invention, the cover includes a hinge that attaches the cover to the open top of the container body, and the cover and the container body are formed such that the cover angles downward so that the hinge is positioned vertically higher than an opposing side of the cover. In this embodiment, the first end of the elastic, flexible filament is mounted on the cabinet to be positioned vertically higher than the second end of the elastic, flexible filament such that when the cabinet door is closed, the elastic, flexible filament pulls the cover towards the closed position and then relaxes to enable the cover to complete movement to and remain in the closed position by the force of gravity, and when the door is moved to the open position, the elastic, flexible filament stretches to urge the cover into the opened position.

In accordance with another aspect of the present invention, the second end is attached to the cabinet by means of a bracket having a first end that is attached to a structural member of the cabinet and a second end that is positioned horizontally between the hinge axis and the first end of the elastic, flexible filament such that as the cabinet door opens, the elastic, flexible filament urges the cover into the opened position, and as the door closes, the elastic, flexible filament pulls the cover into the closed position.

As will be readily appreciated from the foregoing description, the present invention provides a simple, yet effective method for automatically opening and closing a container lid when the container is mounted on the cabinet door and the cabinet door is swung between an open and closed position. More particularly, the elastic, flexible filament is simply and easily attached by means of commercially available hardware to the container lid and to existing cabinet structure. Existing door-mounted containers can be easily and quickly modified to use the device of the present invention. Horizontally-mounted lids can be adapted to use this method because the elastic, flexible filament can be used to raise, lower, and hold the container cover in the closed position. With the method and device of the present invention, cumbersome and complicated mechanical devices are no longer needed. Furthermore, the mounting of the elastic, flexible filament remains out of the way of use of the container and the cabinet, thus avoiding interference with items stored in the cabinet.

BRIEF DESCRIPTION OF THE DRAWINGS

The foregoing and other features and advantages of the present invention will be more readily appreciated as the same becomes better understood from the detailed description when taken in conjunction with the following drawings, wherein:

FIG. 5 is a top plan view of an alternative embodiment illustrating a container having an angled or dropped cover in the closed position; and FIG. 6 is an isometric view of the container of FIG. 5 in the opened position.

DETAILED DESCRIPTION

Figure 1:
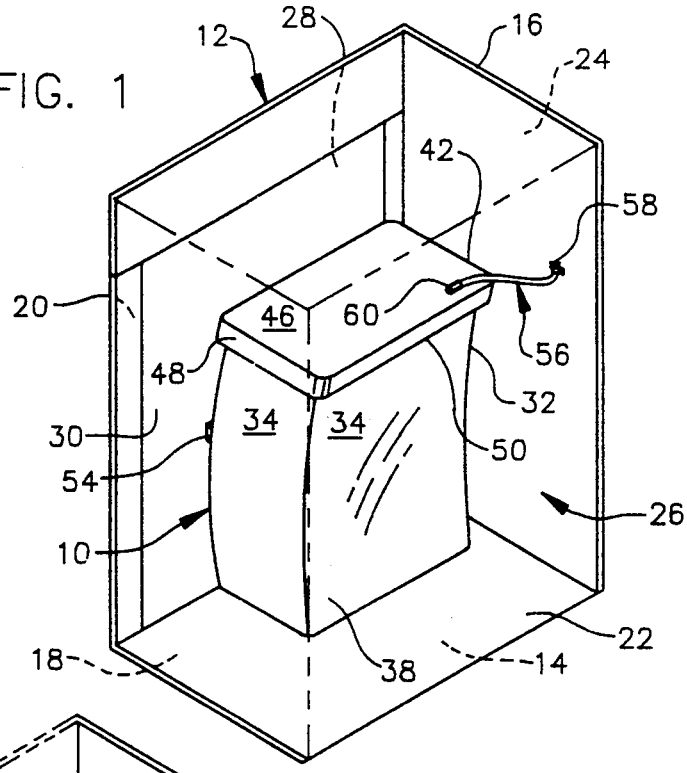
FIG. 1 is an isometric view of a container with the automatic cover formed in accordance with the present invention illustrating the cover in a closed position.

Referring initially to FIGS. 1-4, illustrated therein is a representative embodiment of a container 10 formed in accordance with the present invention mounted within a cabinet 12. The cabinet 12 includes a back wall 14, a first sidewall 16, a second sidewall 18, an open front wall 20, a bottom 22, and a top 24. The back wall 14, second sidewall 18, and top 24 are illustrated in phantom to reveal the interior 26 of the cabinet 12 for purposes of illustration and explanation. The open front wall 20 is covered by a door 28 that is hingedly attached to the open front wall 20 to pivot about a vertical axis. The door 28 includes an inside surface 30 to which the container 10 is mounted.

The container 10 comprises a container body 32 having sides 34 that define an interior 36 having a closed bottom 38. The bottom may include openings to allow air to escape when installing a bag. The sides 34 further define an open top 40 that is covered by a cover 42. The container 10 may be formed of wood, metal, plastic or other suitable material, or a combination thereof.

The cover 42 is hingedly attached by a hinge 44 to the open top 40 of the container body 32 to pivot about a horizontal axis. As illustrated therein, the cover 42 includes a top 46, a pair of parallel, mutually opposing sides 48, and a front 50, and back 52. The back 52 is attached to the hinge 44 that in turn is attached to the side 34 of the container body 32 to move between a closed position illustrated in FIG. 1, wherein the cover 42 substantially covers the open top 40 of the container body 32, and an opened position, illustrated in FIG. 2, wherein the cover 42 is pivoted upward about the hinge 44 so that the top 46 faces the inside surface 30 of the cabinet door 28.

In order to allow clearance for the opening of the cover 42, the container body 32 is attached to the door 28 by means of a bracket 54. The bracket 54 is so formed that the container body 32 is positioned away from the inside surface 30 of the door 28 to provide clearance for the cover 42 as it rotates up and back about the hinge 44. In order to provide additional clearance, or, alternatively, the container body 32 may be curved about its longitudinal vertical axis such that the bottom 38 and open top 40 are offset away from the inside surface 30 of the door 28 by curving the sides 34 of the container body 32.

An elastic, flexible filament 56 has a first end 58 attached to the first sidewall 16 of the cabinet 12 and a second end 60 attached to the top 46 of the cover 42. The elastic, flexible filament 56 can be formed of any suitable elastic material, such as bungee cord, surgical tubing or elastic rubber, that can stretch to approximately fifty percent (50%) of its length while exerting a moderate amount of force. Ideally, the elastic, flexible filament 56 should be attractive as well as have the right tension. The first and second ends 58 and 60 are mounted by suitable hardware to their respective attachment points. More particularly, the first end 58 can be mounted to the first sidewall 16 by an eyelet 62 that is threadably fastened to the first sidewall 16. Alternatively, hooks, staples, or other suitable fastening means may be used. The second end 60 may be attached to the cover 42 by means of adhesive, bolts, staples, or other suitable fasteners. Alternatively, the cover 42 may be constructed to include a preformed attachment point that is integral with the cover 42 to facilitate firm attachment of the second end 60 of the elastic, flexible filament 56.

Figure 2:
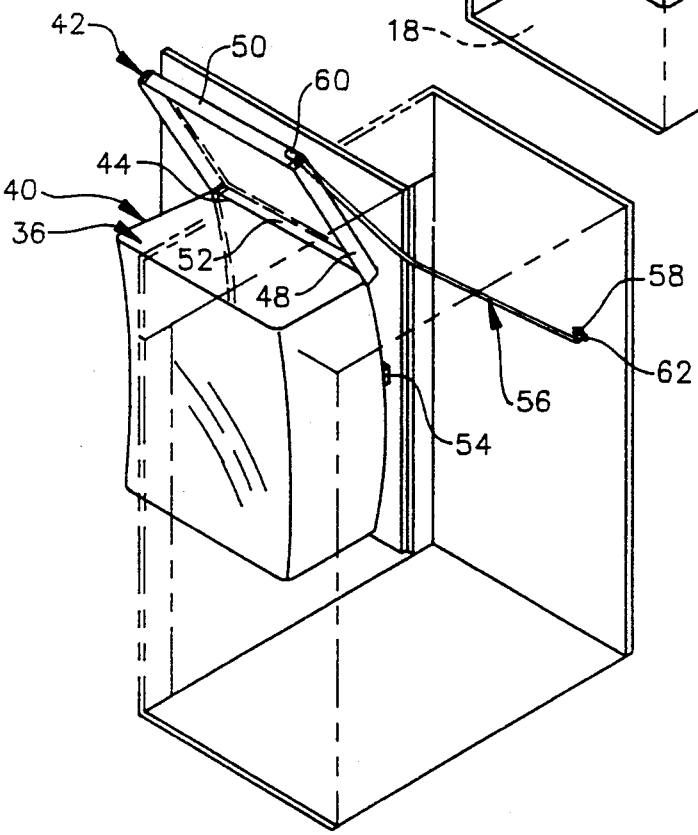
FIG. 2 is an isometric view of the container of FIG. 1 illustrating the cover in the opened position.
Figure 3:
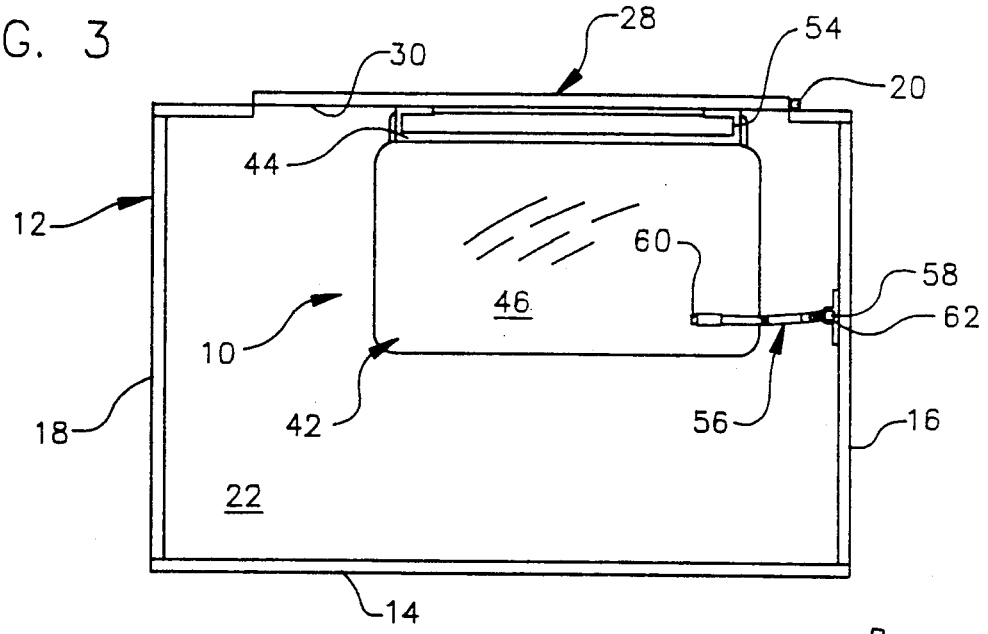
FIG. 3 is a top plan view of the container of FIG. 1.
Figure 4:
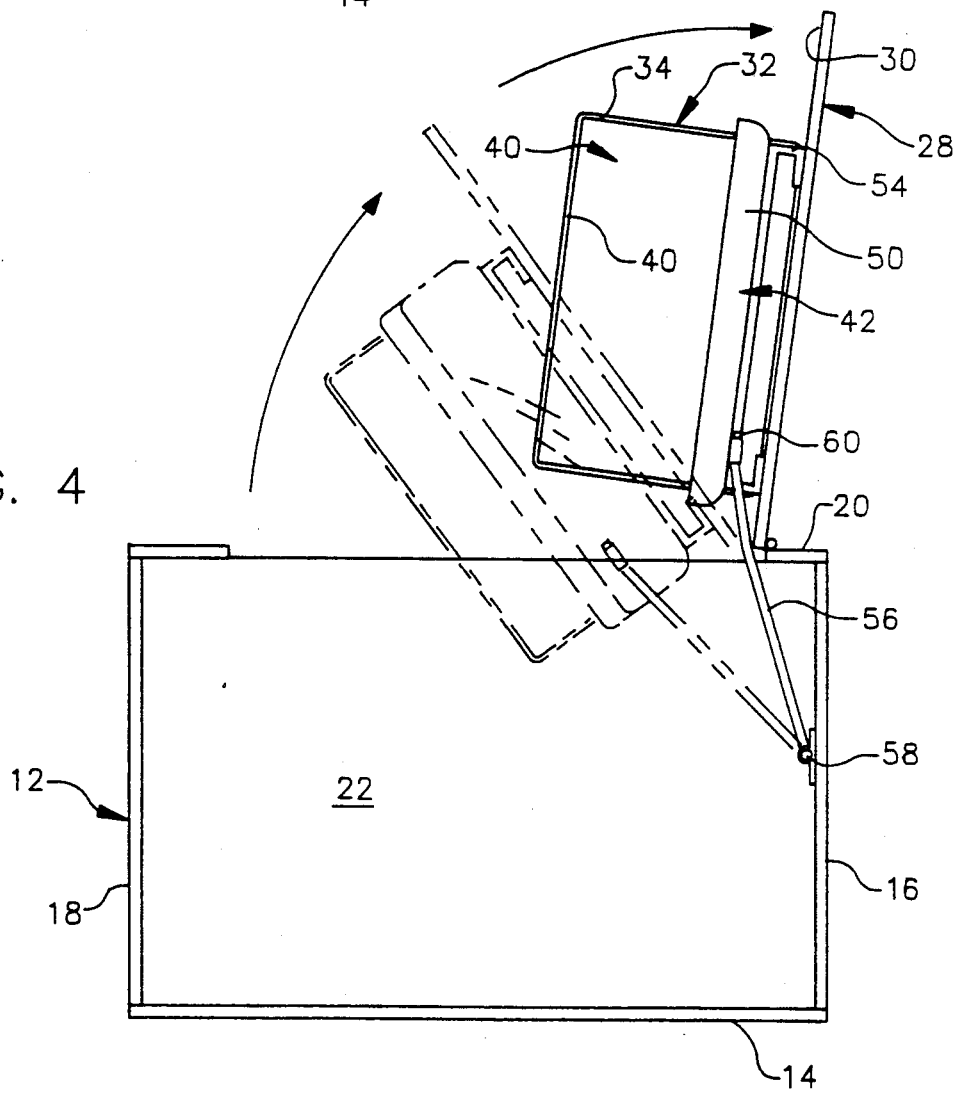
FIG. 4 is a top plan view of the container of FIG. 2.

In the embodiment illustrated in FIGS. 1 and 2, the cover 42 is mounted at substantially a horizontal orientation such that the hinge 44 on the back 52 is at substantially the same vertical level as the front 50 of the cover 42. With this particular construction of container 10, the first end 58 of the elastic, flexible filament 56 can be attached to the first sidewall 16 of the cabinet 12 to be at substantially the same as or, preferably, a lower vertical position than the second end 60 attached to the cover 42. In addition, when the cover 42 is in the closed position, the elastic, flexible filament 56 should not be relaxed, but rather at least slightly taut to hold the cover 42 in the closed position, as illustrated in FIG. 1.

As the door 28 moves to the opened position illustrated in FIG. 2, the cover 42 swings around to stretch the elastic, flexible filament 56 and exert tension on the cover 42 to pull it back. As this occurs, the cover 42 is urged by the elastic, flexible filament 56 to rotate upward about the hinge 44 to the opened position to thereby uncover the open top 40 of the container body 32. Conversely, as the cabinet door 28 moves from the open position illustrated in FIG. 2 to the closed position illustrated in FIG. 1, the elastic, flexible filament 56 pulls the cover 42 downward as the cover 42 swings under the cabinet top 24 and holds the cover 42 in the closed position. This is illustrated more clearly in the top plan views of FIGS. 3 and 4, corresponding respectively to FIGS. 1 and 2.

It is to be understood that the mounting of the first end 58 of the elastic, flexible filament 56 may be altered to vary the opening and closing characteristics of the cover 42. More particularly, altering the position of the first end 58 of the elastic, flexible filament 56 will change the rate and timing of the opening and closing of the cover 42. For instance, moving the first end 58 to a lower vertical position on the first sidewall 16 of the cabinet 12 delays the timing in the opening and closing of the cover 42 while, at the same time, increasing the rate of opening and closing such that the cover 42 rapidly flips open and rapidly closes. While this may be desirable in some applications, it does have the drawback of increasing the noise as the cover 42 is rapidly forced open such that the top 46 may contact the interior surface 30 of the door 28 and, as the cover 42 closes, it rapidly contacts the open top 40 of the container body 32.

Turning now to FIGS. 5 and 6, an alternative embodiment of the invention is illustrated therein. For ease of description, the identical reference numbers will be used in FIGS. 5 and 6 as were used in FIGS. 1–4.

In the embodiment illustrated in FIGS. 5 and 6, the first major difference is in the cover 42 in that it is now formed and mounted on the container body 32 to angle downward. This is known in the trade as a dropped cover. More particularly, in this configuration, the hinge 44 on the back 52 of the cover 42 is positioned vertically higher than the opposing front 50 on the cover 42. With this particular configuration of container 10, the elastic, flexible filament 56 must be mounted so that the first end 58 is positioned on the first sidewall 16 to be vertically higher than the second end 60 mounted on the cover 42. As such, when the door 28 opens, the elastic, flexible filament 56 is stretched to urge the cover 42 to move to the opened position, as illustrated in FIG. 6. However, in this embodiment, when the door 28 moves to the closed position, the elastic, flexible filament 56 initially urges the cover 42 by pulling towards the closed position. As the door 28 moves through the last quarter of closing, the elastic, flexible filament 56 relaxes to permit the cover 42 to fall to the closed position and remain in the closed position by the force of gravity. It has been found that moving the mounting position of the first end 58 to a vertically lower position than the second end 60 of the elastic, flexible filament 56 prevents the cover 42 from opening due to the geometry of the force vectors acting on the cover 42.

It should further be noted that with respect to the embodiment illustrated in FIGS. 1–4, moving the first end 58 substantially lower than the second end 60 will also prevent opening of the cover 42. Thus, if it is desirable with respect to that embodiment to move the first end 58 lower than the second end 60, to urge and hold the cover 42 in the closed position, the vertical separation between the first end 58 and the first end 60 should be as small as possible. It has also further been found that moving the attachment point of the second end 60 of the elastic, flexible filament 56 close to the hinge 44 on the cover 42 shortens the leverage and causes the cover 42 to open and close more rapidly and delay the timing of the opening and closing of the cover 42.

With respect to containers having round lids, because the hinge point between the round lid and the container body is much smaller than on a rectangular container, the tension of the elastic, flexible filament 56 needs to be as low as possible to to prevent distortion of the round cover and hinge.

While a preferred embodiment of the invention has been illustrated and described, it is to be understood that various changes may be made therein without departing from the spirit and scope of the invention. For instance, containers using a frame for holding a bag and having covers hingedly attached thereto can be easily adapted to use the automatic cover of the present invention. Consequently, the invention is to be limited only by the scope of the claims that follow.

The embodiments of the invention in which an exclusive property or privilege is claimed are defined as follows:

1. A container with an automatic cover in combination with a door and a structural member on which the door is hingedly mounted to pivot on a hinge about a vertical hinge axis between an open position and a closed position, the container comprising a container body mounted on said door, said container body having sidewalls, a bottom, and an open top; a cover hingedly attached to said open top of said container body to rotate about a horizontal hinge axis to move between an opened position, wherein said open top of said container body is uncovered, and a closed position, wherein said open top of said container body is covered; an elastic, flexible filament having a first end and a second end; and means for attaching said first end to said structural member other than said door and said hinge, and means for attaching said second end to said cover so that said elastic, flexible filament is suspended between said cover and said structural member, such that as said door is moved to the open position, said elastic, flexible filament stretches over the horizontal hinge axis to provide a means for pulling said cover into said opened position, and as said door is moved into said closed position, said elastic, flexible filament providing a means for urging said cover into said closed position.

2. The container in combination with the door and structural member of claim 1, wherein said first end of said elastic, flexible filament is positioned on said structural member such that as said door is moved to the closed position, said elastic, flexible filament pulls said cover toward said closed position and then relaxes to enable said cover to complete movement to and remain in said closed position by the force of gravity.

3. The container in combination with the door and structural member of claim 1, wherein said first end of said elastic, flexible filament is positioned on said structural member to be vertically level with said second end such that as said door is moved to the closed position, said elastic, flexible filament pulls said cover towards said closed position and maintains tension to hold said cover in said closed position, and as said door is moved into the open position, said elastic, flexible filament stretches to urge said cover into said opened position.

4. The container in combination with the door and structural member of claim 1, wherein said first end is positioned on said structural member to be vertically lower than said second end of said elastic, flexible filament such that as said door is moved to the closed position, said elastic, flexible filament pulls said cover towards said closed position, and maintains tension to hold said cover in said closed position and as said door is moved into the open position, said elastic, flexible filament stretches to pull said cover into said opened position.

5. The container in combination with the door and structural member of claim 1, wherein said cover includes a hinge that attaches a side of said cover to said container body, and further wherein said cover and said container body are formed so that said cover is angled downward such that said hinge is positioned vertically higher than an opposing side of said cover.

6. The container in combination with the door and structural member of claim 5, wherein said first end of said elastic flexible filament is attached to said structural member to be positioned vertically higher than said second end of said elastic, flexible filament such that as said door is moved to the closed position, said elastic, flexible filament pulls said cover towards said closed position and then relaxes to enable said cover to complete movement to and remain in said closed position by the force of gravity.

7. A system for automatically opening and closing a container cover comprising;

a cabinet having a door pivotally mounted on a vertical hinge attached to a structural member of said cabinet such that said door swings about a vertical axis between an open position and a closed position;

a container attached to said door, a cover pivotally attached to said container to swing about a horizontal axis between an opened position and a closed position; and an elastic filament having a longitudinal axis and a first end attached to said cover and a second end attached to said structural member of said cabinet and positioned thereon such that said elastic filament is suspended between said cover and said cabinet to freely stretch as said door swings between said open and closed positions, such that as said door swings to said open position, said elastic filament stretches to provide a means for exerting tension on said cover and the angle between said longitudinal axis of said elastic filament and said horizontal axis increases so that the means for exerting tension swings said cover to said opened position, and as said door swings to said closed position, the angle between said longitudinal axis of said elastic filament and said horizontal axis decreases and said elastic filament provides a means for urging said cover to swing to said closed position.

8. The system of claim 7, wherein said second end of said elastic filament is attached to said cabinet to be positioned vertically higher than said first end of said elastic filament such that as said door swings to said closed position, said elastic filament pulls said cover towards said closed position and then relaxes to enable said cover to complete movement to and remain in said closed position by the force of gravity.

9. The system of claim 7, wherein said second end of said elastic filament is attached to said cabinet to be positioned vertically lower than said first end of said elastic filament such that as said door swings to said closed position, said elastic filament pulls said cover towards said closed position and maintains tension to hold said cover in said closed position.

* * * * *